US008610366B1

(12) United States Patent
Xiong et al.

(10) Patent No.: US 8,610,366 B1
(45) Date of Patent: Dec. 17, 2013

(54) LIGHTING BALLAST AND METHOD FOR BALANCING MULTIPLE INDEPENDENT RESONANT TANKS

(75) Inventors: Wei Xiong, Madison, AL (US); Danny Pugh, Harvest, AL (US); Candice Ungacta, Huntsville, AL (US)

(73) Assignee: Universal Lightning Technologies, Inc., Madison, AL (US)

( * ) Notice: Subject to any disclaimer, the term of this patent is extended or adjusted under 35 U.S.C. 154(b) by 162 days.

(21) Appl. No.: 13/246,359

(22) Filed: Sep. 27, 2011

Related U.S. Application Data

(60) Provisional application No. 61/473,581, filed on Apr. 8, 2011.

(51) Int. Cl.
*H05B 41/16* (2006.01)

(52) U.S. Cl.
USPC ..... 315/282; 315/274; 315/209 R; 315/312; 315/291

(58) Field of Classification Search
USPC ..... 315/274–289, 291, 307, 312–326, 315/185 S, 224, 247
See application file for complete search history.

(56) References Cited

U.S. PATENT DOCUMENTS

| | | | | |
|---|---|---|---|---|
| 4,574,222 | A | 3/1986 | Anderson | |
| 6,118,223 | A | 9/2000 | Canova | |
| 6,472,876 | B1 | 10/2002 | Notohamiprodjo et al. | |
| 7,271,549 | B2 * | 9/2007 | Wey et al. | 315/282 |
| 7,285,921 | B2 * | 10/2007 | Chen | 315/291 |
| 7,291,987 | B2 * | 11/2007 | Chang et al. | 315/282 |
| 2007/0182343 | A1 * | 8/2007 | Kwon | 315/282 |
| 2010/0045200 | A1 * | 2/2010 | Wey et al. | 315/276 |

* cited by examiner

*Primary Examiner* — Tuyet Thi Vo
(74) *Attorney, Agent, or Firm* — Waddey Patterson; Mark J. Patterson

(57) ABSTRACT

A lighting ballast and associated methods balance current through resonant inductors that have inductance variation, and are further effective to balance lamp currents in the range from full brightness to full dimming. The ballast includes a lighting power source, a balancing transformer having a plurality of windings, a first resonant tank circuit having one or more transformer windings and a second resonant tank circuit having a like number of transformer windings. Each of the windings for the first resonant tank are reversed in direction in association with a corresponding winding for the second resonant tank, such that the only current passing through the windings is a current difference between the two windings.

17 Claims, 4 Drawing Sheets

LIGHTING BALLAST AND METHOD FOR BALANCING MULTIPLE INDEPENDENT RESONANT TANKS

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application(s) which is/are hereby incorporated by reference: None

BACKGROUND OF THE INVENTION

The present invention relates generally to gas discharge lighting ballasts for powering multiple lamps in parallel. More particularly, the present invention relates to a lamp ballast topology and associated method to match multiple independent resonant tanks for parallel lamp operation.

An electronic ballast with multiple parallel independent lamp operation is generally desirable so that if one lamp fails the remaining lamps will still be functional. This feature allows for significantly reduced maintenance costs because there is correspondingly no need to replace the failed lamp immediately if such replacement is inconvenient or impractical under the circumstances.

One convention ballast topology that provides multiple parallel independent lamp operation is to use multiple independent resonant tanks, as in the circuit 110 shown in FIG. 1. Multiple lamp applications may be easily expanded based on the two-lamp application shown.

Referring to FIG. 1, an equivalent AC input voltage source V_in may typically be the output of a half-bridge inverter circuit. The frequency of the input voltage V_in is adjustable for dimming applications. Inductors L_res_1, L_res_2 are resonant inductors for the respective resonant tanks. Capacitors C_res_1, C_res_2 are resonant capacitors for the respective resonant tanks. DC blocking capacitors C1, C2 are coupled between the resonant inductors and the lamps in the respective resonant tanks, with L_res_1, C_res_1, C1 and Lamp1 forming a first series resonant tank 112*a* and L_res_2, C_res_2, C2 and Lamp2 forming a second series resonant tank 112*b*. Bidirectional switches S1 and S2 can be turned on or turned off for single-lamp and two-lamp applications, or alternatively where Lamp1 or Lamp2 have failed.

For series resonant tanks, the lamp current (I_lamp) is dependent on the resonant circuit quality factor (Q) and operating frequency (f). Represented in FIG. 2 are typical output characteristics (lamp current- vs. operating frequency curve) for a series resonant circuit. Output curve 1 represents the output characteristic for the first resonant tank 112*a*, and output curve 2 represents the output characteristic for the second resonant tank 112*b*. Because the resonant components will not generally be exactly the same in the resonant tanks, the two output curves will accordingly be different as well. For the same operating frequency (f_steady), the lamp currents I_lamp1, I_lamp2 will not be the same. The higher the Q of the resonant tank, the bigger the difference between the lamp currents.

A conventional lamp current balancing method as represented in FIG. 3 will not be sufficient to balance the lamp current and resonant inductor current for two independent resonant tanks. If a lamp current balancing transformer T1 is designed to be sufficiently large, the transformer T1 will be able to balance the lamp current. However, the difference in resonant inductor current will be amplified by the transformer T1, as described below:

$$V2=V_c2+V_\text{lamp}2+V_T1B;$$

$$V1=V_c1+V_\text{lamp}1+V_T1A;$$

In the above equations, V1 and V2 are the voltages across the resonant inductors L_res1 and L_res2, respectively. If the lamp currents are balanced to be the same by the transformer T1, then:

$$V_c1=V_c2;$$

$$V_\text{lamp}1=V_\text{lamp}2;\ \text{and}$$

$$V2-V1=V_T1B-V_T1A$$

Because the voltages V_T1B and V_T1A are different by 180 degrees due to the transformer design, $$V2-V1=2*(V_T1A)$$

As demonstrated herein, a large voltage difference will therefore be seen across the resonant inductors L_res1 and L_res2. The large voltage difference will further cause a large current difference through the resonant inductors. This current differential makes design of the resonant inductors exceedingly difficult because the current could be almost any value depending on the voltage across the transformer T1. This feature also makes the ballast thermal design very difficult, as the increased current results in a measurably increased temperature for the inductor as well.

If the Q or output characteristic of the two resonant tanks are sufficiently close, the lamp currents I_lamp1 and I_lamp2, respectively, would also be very close so that the voltage across the transformer T1 would correspondingly be quite small. As a result the current imbalance for the respective resonant inductors would be substantially reduced.

In practice, the resonant capacitors typically have very low variation (e.g., 1-3%). The inductance of the resonant inductor may however vary across a typical range of about 5-10%. Therefore, balancing of the inductor current or resonant inductance is an important consideration for balancing of the lamp currents and thereby solving the thermal imbalance for resonant inductors.

BRIEF SUMMARY OF THE INVENTION

A resonant tank topology and associated methods are herein provided in accordance with the present invention to match multiple independent resonant tanks in a lamp ballast for parallel lamp operation.

In another aspect of the present invention, a resonant current and lamp current balancing method is provided for multiple independent resonant tanks.

In another aspect, a method is provided for disabling associated balancing transformer windings in multiple resonant tanks.

In a particular embodiment of the present invention, a lighting ballast and associated methods are provided to balance current through resonant inductors that have inductance variation, and further effective to balance lamp currents in the range from full brightness to full dimming. The ballast includes a lighting power source, one or more balancing transformers having a plurality of windings, a first resonant tank circuit having one or more transformer windings and a second resonant tank circuit having a like number of transformer windings. Each of the windings for the first resonant tank are reversed in direction in association with a corresponding winding for the second resonant tank, such that the only current passing through the windings is a current difference between the two windings.

In another embodiment, a lighting ballast in accordance with the present invention includes a lighting power source, a balancing transformer with a plurality of windings, a first resonant tank circuit having a plurality of the transformer windings and a second resonant tank circuit having at least as many of said transformer windings as are present in the first tank circuit. Each of the windings for the first resonant tank is reversed in direction in association with a corresponding winding for the second resonant tank.

In another embodiment, a lighting ballast in accordance with the present invention includes a lighting power source, first and second balancing transformers each having a plurality of windings, a first resonant tank circuit having one or more windings from each of the first and second transformers, and a second resonant tank circuit having one or more windings from each of the first and second transformers. Each of the windings for the first resonant tank is reversed in direction in association with a corresponding winding for the second resonant tank.

In various embodiments, the lighting ballast may further include a transformer disabling control circuit with one or more switching elements and transformer windings coupled to a large capacitor. Operation of the switching elements either causes the balancing transformer to operate normally or to effectively short, wherein one or more of the resonant tanks are disabled. In this manner the ballast may properly operate with fewer lamps than available resonant tanks.

DETAILED DESCRIPTION OF THE INVENTION

Figure 1:
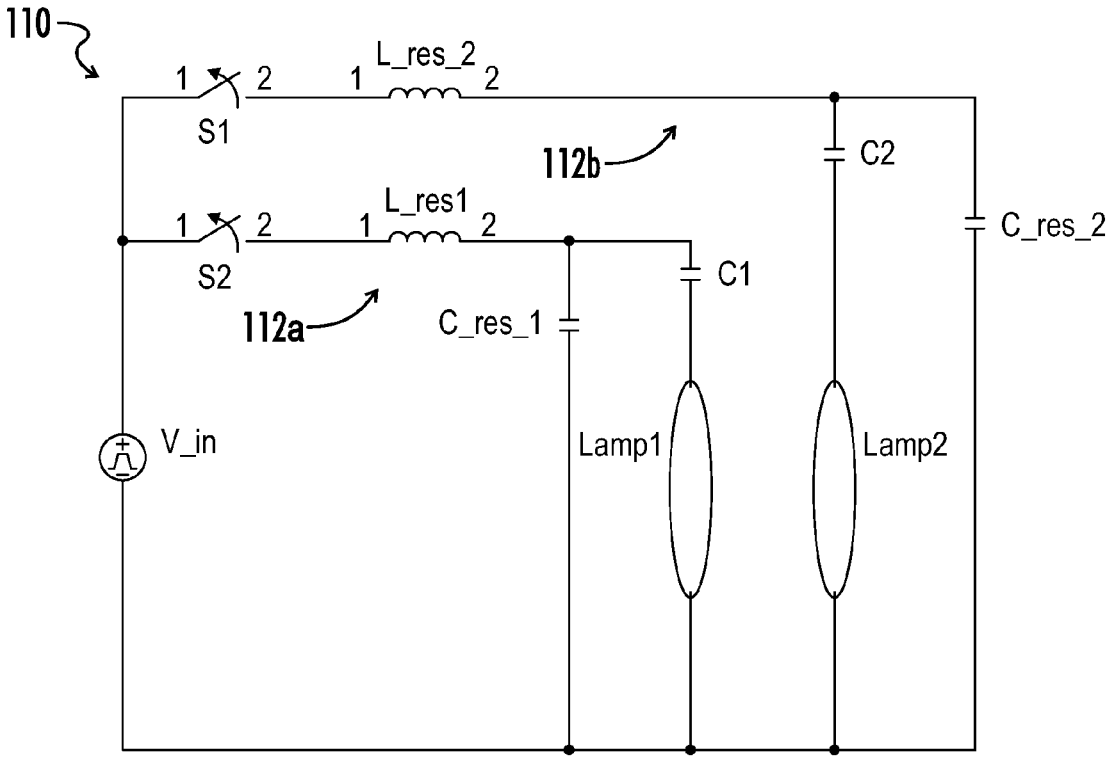
FIG. 1 (PRIOR ART)
FIG. 1 is a circuit diagram representing a resonant tank topology as previously known in the art.
Figure 2:
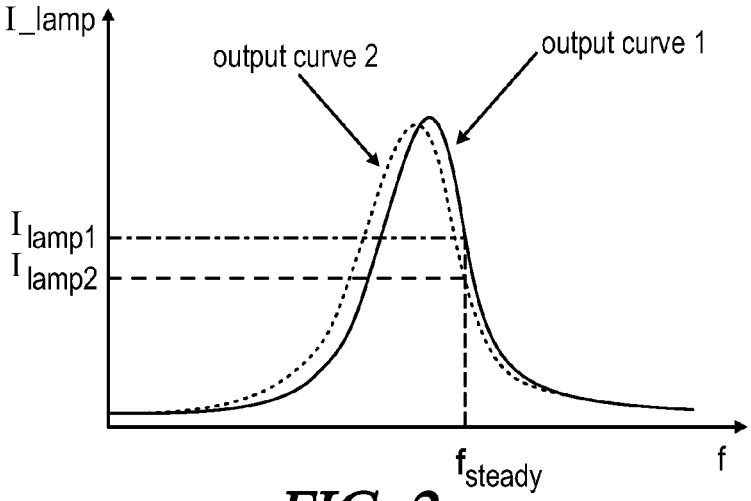
FIG. 2 (PRIOR ART)
FIG. 2 is a graphical diagram representing typical output characteristics for the resonant tank topology of FIG. 1.
Figure 3:
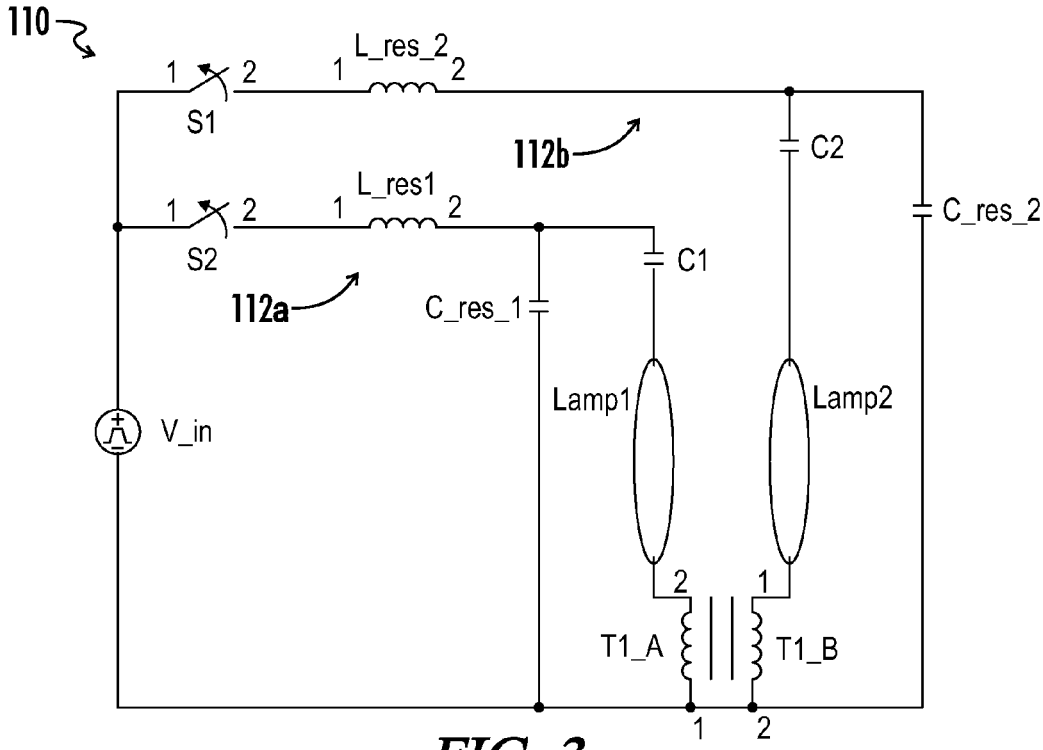
FIG. 3 (PRIOR ART)
FIG. 3 is a circuit diagram representing a lamp balancing resonant tank topology as previously known in the art.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

The term "coupled" means at least either a direct electrical connection between the connected items or an indirect connection through one or more passive or active intermediary devices. The term "circuit" means at least either a single component or a multiplicity of components, either active and/or passive, that are coupled together to provide a desired function. The term "signal" as used herein may include any meanings as may be understood by those of ordinary skill in the art, including at least one current, voltage, charge, temperature, data or a state of one or more memory locations as expressed on one or more transmission mediums.

The terms "switching element" and "switch" may be used interchangeably and may refer herein to at least: a variety of transistors as known in the art (including but not limited to FET, BJT, IGBT, JFET, etc.), a switching diode, a silicon controlled rectifier (SCR), a diode for alternating current (DIAC), a triode for alternating current (TRIAC), a mechanical single pole/double pole switch (SPDT), or electrical, solid state or reed relays. Where either a field effect transistor (FET) or a bipolar junction transistor (BJT) may be employed as an embodiment of a transistor, the scope of the terms "gate," "drain," and "source" includes "base," "collector," and "emitter," respectively, and vice-versa.

Terms such as "providing," "processing," "supplying," "determining," "calculating" or the like may refer at least to an action of a computer system, computer program, signal processor, logic or alternative analog or digital electronic device that may be transformative of signals represented as physical quantities, whether automatically or manually initiated.

Referring generally to FIGS. 4-7, various embodiments are described herein for a lighting ballast having multiple independent resonant tank circuits and associated methods for parallel lamp operation. Where the various figures may describe embodiments sharing various common elements and features with other embodiments, similar elements and features are given the same reference numerals and redundant description thereof may be omitted below.

Figure 4:
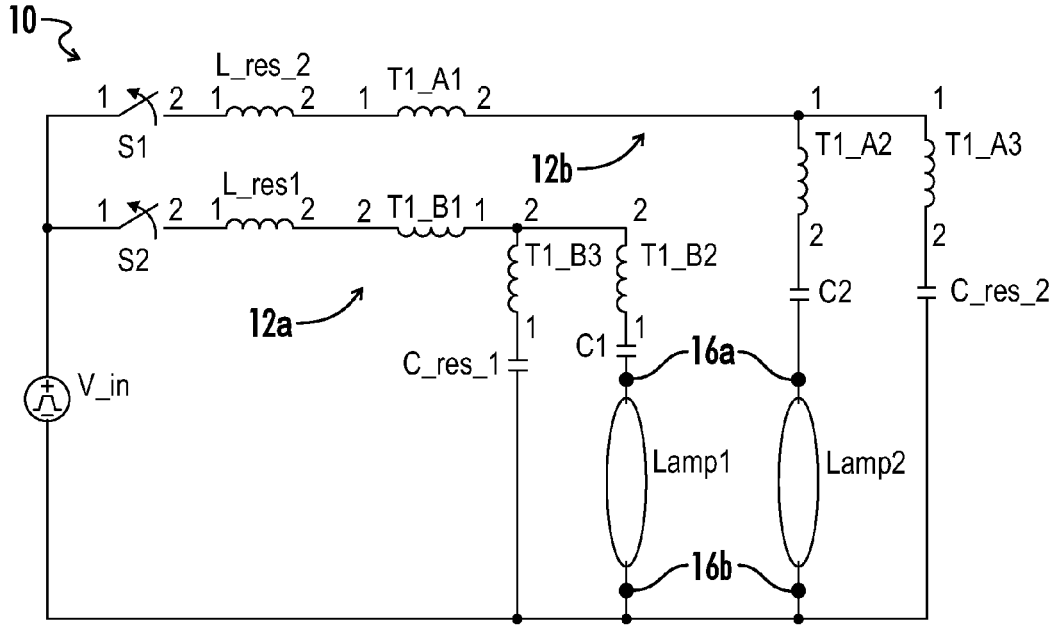
FIG. 4 is a circuit diagram representing an embodiment of a resonant tank topology of the present invention.

Referring first to an exemplary embodiment as represented in FIG. 4, a lighting ballast 10 in accordance with the present invention is provided with first and second independent resonant tank circuits 12*a*, 12*b*, respectively, coupled across positive and negative terminals of an input voltage source V_in which may generally but without express limitation be the output from an inverter circuit (not shown) associated with the ballast 10. The first resonant tank 12*a* as shown includes a resonant inductor L_res1 coupled on a first end to the positive terminal of the voltage source V_in via a switching element S2, a resonant capacitor C_res1 coupled between a second end of the resonant inductor L_res1 and the negative terminal of the voltage source V_in, and a capacitor C1 coupled in series with first and second lamp connection terminals 16*a*, 16*b* across (in parallel with) the resonant capacitor C_res1.

A balancing transformer T1 is provided to substantially match the two independent resonant tanks 12*a*, 12*b*. The first resonant tank 12*a* includes transformer windings T1_B1, T1_B2, T1_B3 which are each coupled on a first end to a common node and further coupled on a second end to the resonant inductor L_res1, the first lamp connection terminal 16*a* for the first tank, and the resonant capacitor C_res1, respectively. The second resonant tank 12*b* includes transformer windings T1_A1, T1_A2, T1_A3 which are each coupled on a first end to a common node and further coupled on a second end to the resonant inductor L_res2, the first lamp connection terminal 16*a* for the second tank, and the resonant capacitor C_res2, respectively.

In various embodiments, each of the windings for the first resonant tank 12*a* is reversed in direction in association with a corresponding winding for the second resonant tank 12*b*. The only current flowing through any corresponding set of windings may therefore be defined as a current differential between that set of windings.

As represented in FIG. 4, transformer windings T1_A1 and T1_B1 define a first set of windings which may be used to balance the resonant inductor current. Transformer windings T1_A2 and T1_B2 define a second set of windings which may be used to balance the current through lamps connected to the respective lamp connection terminals (the lamp currents-I_lamp1, I_lamp2). Transformer windings T1_A3 and T1_B3 define a third set of windings which may be used to balance the resonant capacitor current. The voltage across the balancing transformer T1 caused by whatever relatively small unbalanced current is generated through the independent resonant tanks may, in accordance with embodiments as described above, automatically balance the resonant inductor current and the lamp current.

When there is only one lamp coupled to the lamp connection terminals of one of the resonant tanks 12*a*, 12*b*, due, for example, to end-of-life failure or other like reasons, the switching elements S1 or S2 coupled to the resonant tank associated with the failed lamp may be opened to disable the tank. The switching element may be driven to turn on and off by, for example, a controller which is effective to determine an end-of-life failure or an open circuit across the associated lamp connection terminals and to control the switch state accordingly. Such processes are known in the art and further description may accordingly be omitted herein.

Figure 5:
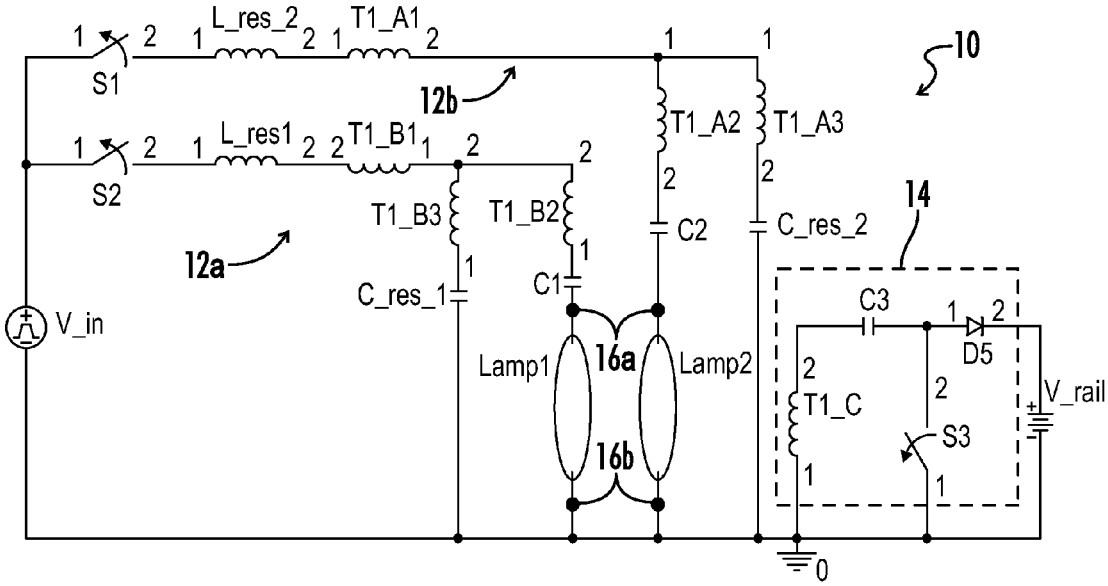
FIG. 5 is a circuit diagram representing an alternative embodiment of the topology of FIG. 4 with a disabling control circuit.

However, in an embodiment of the present invention, a resonant tank disabling control circuit 14 may be provided to disable the balancing transformer T1 during such conditions and facilitate proper single-lamp operation for the ballast 10. Referring to FIG. 5, in one embodiment the control circuit 14 includes a switching element S3 coupled across positive and negative terminals of a voltage source, which may be, for example, a rail voltage (V_rail) and ground terminal for the ballast. A diode D5 may have its anode coupled to the switch S3 and its cathode coupled to the rail voltage terminal V_rail. A seventh balancing transformer winding T1_C is coupled in series with a capacitor C3 across (in parallel with) the switching element S3. The switching element S3 may be driven in accordance with the turning on or off of the other two switching elements S1, S2, or alternatively may be driven independently of the other switches in a literal sense but still turned on and off based, for example, on the detection of either a multi-lamp or single-lamp operating condition for the ballast. Driving circuitry for the switching element S3 is not shown but is well known in the art.

When the switching element S3 is driven to be in a first switch state (e.g., open), the balancing transformer T1 is allowed to function normally. However, when the switching element S3 is driven to be in a second switch state (e.g., closed), the transformer winding T1_C is shorted with the capacitor C3 so that the voltage across the winding T1_C is limited to a value defined by the capacitance of the capacitor C3 and the turns ratio N between the transformer windings T1_C and T1_A. If the capacitance of the capacitor C3 is sufficiently large, the voltage drop across the capacitor C3 will be small enough that the transformer T1 is substantially shorted when the switching element S3 is closed.

In embodiments of the present invention as described above and more particularly with reference to FIGS. 4-5, a core size for the balancing transformer and associated conductor sizes may generally be designed to be sufficiently large to accommodate large currents flowing passing through the transformer. Alternative embodiments may be provided with reference to FIGS. 6-7 which may accordingly reduce the size of the balancing transformer T1.

Figure 6:
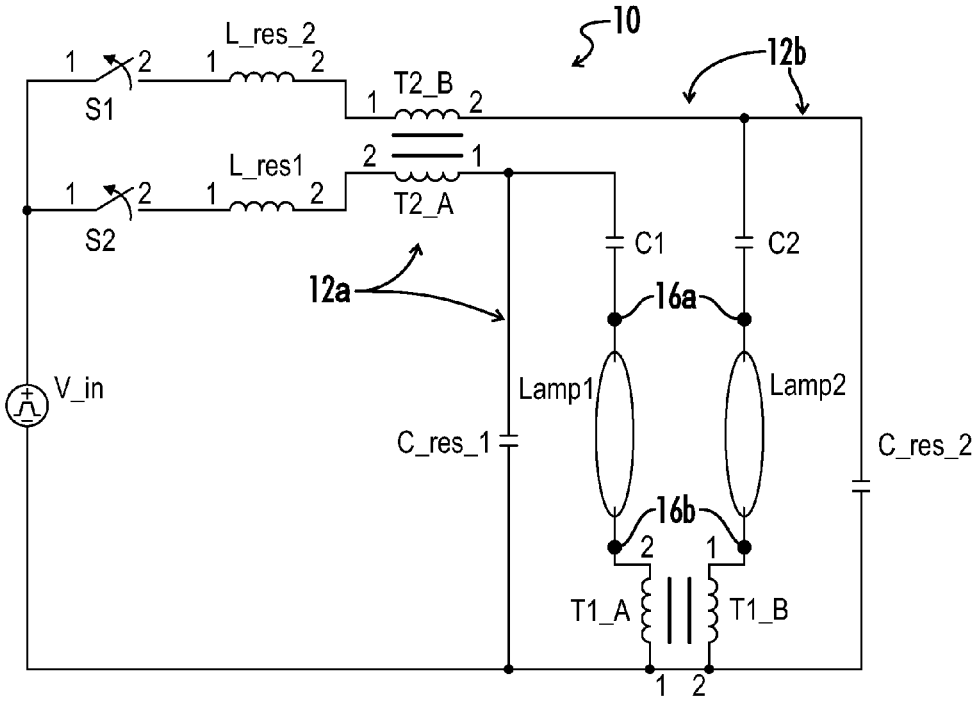
FIG. 6 is a circuit diagram representing another embodiment of a resonant tank topology of the present invention.

Referring first to an embodiment as represented in FIG. 6, a first transformer T1 may be dedicated for balancing of the lamp current and a second transformer T2 may be dedicated for balancing of the resonant inductor current. With the resonant tank components otherwise disposed substantially the same as described with respect to the embodiment of FIG. 4, a first winding T1_A from the first transformer T1 is coupled between lamp connection terminal 16*b* of the first tank 12*a* and the negative power source terminal (e.g., ground). A second winding T1_B from the first transformer T1 is coupled between lamp connection terminal 16*b* of the second tank 12*b* and the negative power source terminal. The first and second windings T1_A, T1_B from the first transformer T1 may be magnetically coupled to each other but reversed in direction with respect to each other as demonstrated in FIG. 6 and similarly described above.

A first winding T2_A from the second transformer T2 is coupled between the resonant inductor L_res1 of the first tank 12*a* and a node between the resonant capacitor C_res1 and the capacitor C1. A second winding T2_B from the second transformer T2 is coupled between the resonant inductor L_res2 of the second tank 12*b* and a node between the resonant capacitor C_res2 and the capacitor C2. The first and second windings T2_A, T2_B from the second transformer T2 may be magnetically coupled to each other but reversed in direction with respect to each other as shown in FIG. 6 and further as similarly described above.

Figure 7:
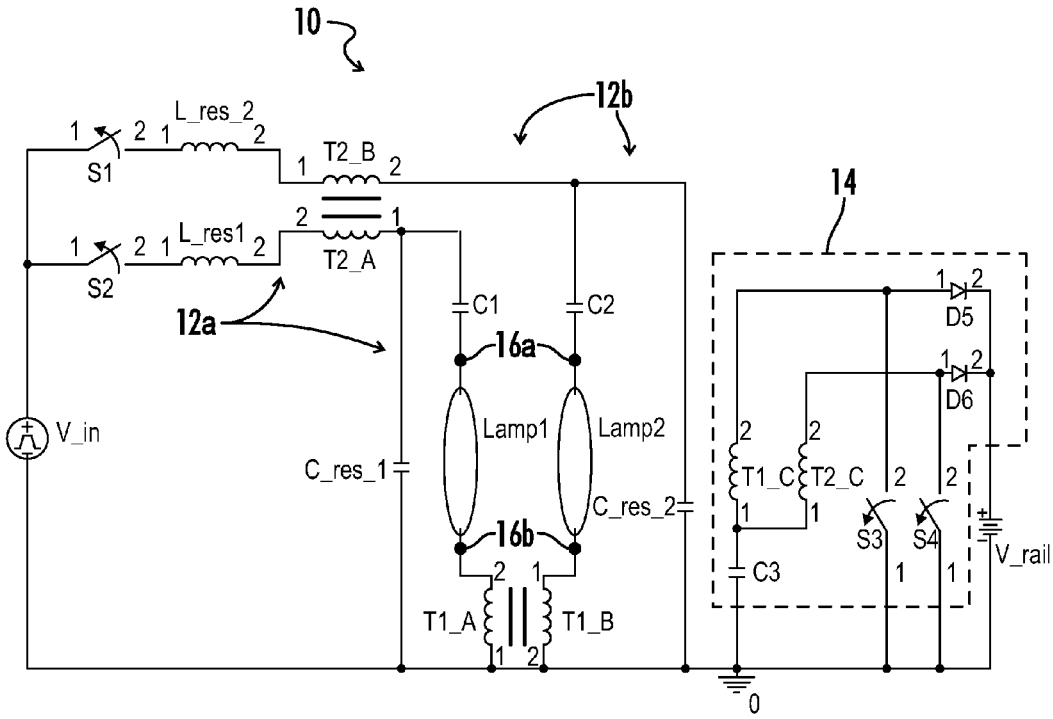
FIG. 7 is a circuit diagram representing an alternative embodiment of the topology of FIG. 6 with a disabling control circuit.

Referring further to FIG. 7, in one embodiment a resonant tank disabling control circuit 14 may be provided in association with the topology of FIG. 6. A first control loop is defined substantially as described above with respect to FIG. 5, and includes a switching element S3 coupled in series with a diode D5 across a positive rail terminal and a negative rail terminal, and a supplemental winding T1_C from the first transformer T1 coupled in series with a capacitor C3 across (in parallel with) the switching element S3. A second control loop further includes a switching element S4 coupled in series with a diode D6 across the positive rail terminal and the negative rail terminal, and a supplemental winding T2_C from the second transformer T2 coupled to a node between the capacitor C3 and the other supplemental winding T2_C, the supplemental winding T2_C together with the capacitor C3 forming a series circuit coupled across (in parallel with) the switching element S4.

The control circuit is effective (in similar manner to the control circuit represented in FIG. 5 and as described above) when each of the switching elements are in a first switch state (e.g., open) to operate the first and second resonant tanks. When at least one of the switching elements are in a second switch state (e.g., closed) the control circuit is effective to substantially short and disable the associated balancing transformers.

The previous detailed description has been provided for the purposes of illustration and description. Thus, although there have been described particular embodiments of the present invention of a new and useful "Lighting Ballast and Method for Balancing Multiple Independent Resonant Tanks," it is not intended that such references be construed as limitations upon the scope of this invention except as set forth in the following claims.

What is claimed is:

1. A lighting ballast comprising:

one or more balancing transformers comprising a plurality of transformer windings;

a first resonant tank circuit comprising one or more of said transformer windings; and a second resonant tank circuit comprising a like number of said transformer windings, each of the windings for the first resonant tank being reversed in direction in association with a corresponding winding for the second resonant tank;

a transformer disabling control circuit including one or more switching elements and a winding from each of the one or more balancing transformers;

the control circuit is effective when the switching element is in a first switch state to operate the first and second resonant tanks; and the control circuit is effective when the switching element is in a second switch state to substantially disable the associated balancing transformers.

2. The lighting ballast of claim 1, each of the first and second resonant tank circuits further comprising a resonant inductor, a resonant capacitor, and first and second lamp connection terminals, at least one of the transformer windings for the first resonant tank and a corresponding at least one of the transformer windings for the second resonant tank defining a first set of windings being reversed in direction with respect to each other, further being coupled in series with respective resonant inductors and effective in combination to balance currents through the respective resonant inductors.

3. The lighting ballast of claim 2, at least one of the transformer windings for the first resonant tank and a corresponding at least one of the transformer windings for the second resonant tank defining a second set of windings being reversed in direction with respect to each other, further being coupled in series with respective lamp connection terminals and effective in combination to balance currents through lamps coupled to the respective lamp connection terminals.

4. The lighting ballast of claim 3, the one or more balancing transformers comprising a first transformer further comprising the first set of windings and a second transformer further comprising the second set of windings.

5. The lighting ballast of claim 3, at least one of the transformer windings for the first resonant tank and a corresponding at least one of the transformer windings for the second resonant tank defining a third set of windings being reversed in direction with respect to each other, further being coupled in series with respective resonant capacitors and effective in combination to balance currents through the respective resonant capacitors.

6. The lighting ballast of claim 5, comprising a single balancing transformer including each of the first, second and third sets of windings.

7. The lighting ballast of claim 5, the one or more balancing transformers comprising a first transformer further comprising the first set of windings, a second transformer further comprising the second set of windings, and a third transformer further comprising the third set of windings.

8. A lighting ballast comprising:

a lighting power source;

a balancing transformer comprising a plurality of windings;

a first resonant tank circuit comprising a plurality of said transformer windings; and a second resonant tank circuit comprising at least as many of said transformer windings as comprised in the first tank circuit, each of the windings for the first resonant tank being reversed in direction in association with a corresponding winding for the second resonant tank;

a transformer disabling control circuit including a switching element and a winding from the balancing transformer;

the control circuit is effective when the switching element is in a first switch state to operate the first and second resonant tanks; and the control circuit is effective when the switching element is in a second switch state to substantially disable the balancing transformer.

9. The lighting ballast of claim 8, the control circuit further comprising the switching element being coupled across a positive rail terminal and a negative rail terminal, and the transformer winding being coupled in series with a capacitor, the series-connected transformer winding and capacitor being further coupled in parallel with the switching element.

10. The lighting ballast of claim 8, each of the first and second resonant tank circuits further comprising a resonant inductor, a resonant capacitor, and first and second lamp connection terminals, at least one of the transformer windings for the first resonant tank and a corresponding at least one of the transformer windings for the second resonant tank defining a first set of windings being reversed in direction with respect to each other, further being coupled in series with respective resonant inductors and effective in combination to balance currents through the respective resonant inductors.

11. The lighting ballast of claim 10, at least one of the transformer windings for the first resonant tank and a corresponding at least one of the transformer windings for the second resonant tank defining a second set of windings being reversed in direction with respect to each other, further being coupled in series with respective lamp connection terminals and effective in combination to balance currents through lamps coupled to the respective lamp connection terminals.

12. The lighting ballast of claim 11, at least one of the transformer windings for the first resonant tank and a corresponding at least one of the transformer windings for the second resonant tank defining a third set of windings being reversed in direction with respect to each other, further being coupled in series with respective resonant capacitors and effective in combination to balance currents through the respective resonant capacitors.

13. A lighting ballast comprising:

first and second balancing transformers each comprising a plurality of windings;

a first resonant tank circuit comprising one or more windings from each of said first and second transformers; and a second resonant tank circuit comprising one or more windings from each of said first and second transformers, each of the windings for the first resonant tank being reversed in direction in association with a corresponding winding for the second resonant tank;

a transformer disabling control circuit including a capacitor, first and second switching elements, a winding from the first balancing transformer coupled to the first switching element and the capacitor, and a winding from the second balancing transformer coupled to the second switching element and the capacitor;

the control circuit is effective when each of the switching elements are in a first switch state to operate the first and second resonant tanks; and the control circuit is effective when at least one of the switching elements are in a second switch state to disable the associated balancing transformers.

14. The lighting ballast of claim 13 further comprising:

a first control circuit loop comprising the first switching element coupled across a positive rail terminal and a negative rail terminal, and the winding from the first transformer coupled in series with the capacitor, the series-connected transformer winding and capacitor being further coupled in parallel with the first switching element; and a second control circuit loop comprising the second switching element coupled across the positive rail terminal and the negative rail terminal, and the winding from the second transformer coupled in series with the capacitor, the series-connected transformer winding and capacitor being further coupled in parallel with the second switching element.

15. The lighting ballast of claim 13, each of the first and second resonant tank circuits further comprising a resonant inductor, a resonant capacitor, and first and second lamp connection terminals, at least one of the transformer windings for the first resonant tank and a corresponding at least one of the transformer windings for the second resonant tank defining a first set of windings being reversed in direction with respect to each other, further being coupled in series with respective resonant inductors and effective in combination to balance currents through the respective resonant inductors.

16. The lighting ballast of claim 15, at least one of the transformer windings for the first resonant tank and a corresponding at least one of the transformer windings for the second resonant tank defining a second set of windings being reversed in direction with respect to each other, further being coupled in series with respective lamp connection terminals and effective in combination to balance currents through lamps coupled to the respective lamp connection terminals.

17. The lighting ballast of claim 16, the first balancing transformer comprising the first set of windings and the second balancing transformer comprising the second set of windings.

* * * * *